US007178349B2

(12) United States Patent
Roh et al.

(10) Patent No.: US 7,178,349 B2
(45) Date of Patent: Feb. 20, 2007

(54) SYSTEM AND METHOD FOR SWITCHING COMMUNICATION MODE OF A DETACHABLE PAD REFRIGERATOR

(75) Inventors: Young Hoon Roh, Seoul (KR); Jung Ho Kim, Seoul (KR); Jin Cheol Cho, Seoul (KR); Jae Won Chang, Seoul (KR); Sang Hyuk Kang, Pusan (KR); Sang Mahn Kim, Kyunggi-do (KR); Pan Su Kim, Kyunggi-do (KR); Kwang Hui Hong, Seoul (KR)

(73) Assignee: LG Electronics Inc., Seoul (KR)

( * ) Notice: Subject to any disclaimer, the term of this patent is extended or adjusted under 35 U.S.C. 154(b) by 264 days.

(21) Appl. No.: 10/769,926

(22) Filed: Feb. 3, 2004

(65) Prior Publication Data

US 2004/0154318 A1 Aug. 12, 2004

(30) Foreign Application Priority Data

Feb. 3, 2003 (KR) ..... 10-2003-0006582

(51) Int. Cl.
*F25D 25/00* (2006.01)

(52) U.S. Cl. ..... 62/125; 62/126; 62/128; 62/130

(58) Field of Classification Search ..... 62/125, 62/126, 127, 128, 129, 130, 131, 230; 236/51, 236/94; 165/11.1, 11.2; 379/93.07, 100.12; 164/11.1, 11.2
See application file for complete search history.

(56) References Cited

U.S. PATENT DOCUMENTS 4,837,812 A * 6/1989 Takahashi et al. ..... 379/93.07
6,028,984 A * 2/2000 Kimball ..... 709/249
6,131,136 A * 10/2000 Liebenow et al. ..... 710/316
6,453,687 B2 * 9/2002 Sharood et al. ..... 62/127
6,644,046 B2 11/2003 Roh et al.

FOREIGN PATENT DOCUMENTS

KR 2002-0030222 4/2002
KR 2002-0047618 6/2002

OTHER PUBLICATIONS

English Language Abstract of KR 2002-0047618.
English Language Abstract of KR 2002-0030222.

* cited by examiner

*Primary Examiner*—Marc Norman
*Assistant Examiner*—Gene Bankhead
(74) *Attorney, Agent, or Firm*—Greenblum & Bernstein, P.L.C.

(57) ABSTRACT

A system and method for switching a communication mode of a detachable pad refrigerator, wherein the attachment/detachment of a client pad to/from the refrigerator is sensed and the communication mode of the refrigerator with the client pad is switched to a wired/wireless communication mode according to the sensed result so that signals can be transmitted and received in the switched communication mode. The client pad is detachably attached to the outer surface of the refrigerator. A communication module is installed in the refrigerator to transmit and receive signals to/from the client pad by wire or wirelessly. A refrigerator control unit is adapted to control the communication module to automatically switch the communication mode of the refrigerator with the client pad to the wired/wireless communication mode according to the attachment/detachment of the client pad. Therefore, the present invention has the effect of increasing the client pad's use efficiency and user's convenience, and stability of signal transmission and reception owing to the automatic switching between the wired communication mode and the wireless communication mode.

15 Claims, 6 Drawing Sheets

SYSTEM AND METHOD FOR SWITCHING COMMUNICATION MODE OF A DETACHABLE PAD REFRIGERATOR

BACKGROUND OF THE INVENTION

1. Field of the Invention

The present invention relates to a refrigerator with a client pad detachably attached thereto, and more particularly to a system and method for switching a communication mode of a detachable pad refrigerator (which is also referred to as a pad-detachable refrigerator), wherein the attachment/detachment of a client pad to/from the refrigerator is sensed and the communication mode of the refrigerator is switched to a wired/wireless communication mode according to the sensed result so that signals can be transmitted and received in the switched communication mode.

2. Description of the Related Art

The configuration of a conventional refrigerator will hereinafter be described with reference to FIG. 1.

The conventional refrigerator R is a home appliance that has an inner compartment for storage of food and in which a refrigerant circulates while being maintained at a low temperature to insulate the inner compartment from heat and preserve the food from decay so as to keep it in a fresh state for a long time.

The conventional refrigerator R has hardware connectable to an external Internet network, such as an Internet modem, in addition to the above-mentioned basic refrigeration function. As a result, the refrigerator can access a desired Web page to transmit and receive data thereto/therefrom and retrieve and acquire desired information therefrom.

In general terms, the refrigerator R is operated 24 hours every day to keep food at a low temperature. In this connection, the refrigerator R is equipped with a chipset for processing of data and a memory for storage of user data so that it can function as a home server to manage/control networking of one or more home appliances connected to an internal network constructed in a building and recognized as clients.

The home server function signifies monitoring the states of one or more home appliances connected to the internal network constructed in the building, or controlling signal flows of the home appliances. By performing this home server function, the refrigerator R can manage/control the state of the internal network and relay between the external network and the internal network of the building through the Internet modem, thereby making it possible to remotely control the home appliances in the building.

To this end, the refrigerator R includes a display unit 1 and an input unit (not shown) mounted on its outer surface. The input unit functions to input a user's command and may be a button panel or touch pad. Therefore, the user can monitor multimedia data transmitted and received over the Internet, or state information of the home appliances connected to the internal network.

Since the display unit 1 mounted on the outer surface of the conventional refrigerator R is typically limited in thickness, it may preferably be a thin monitor such as a liquid crystal display (LCD) monitor. The user can input a control command or monitor an output situation through the display unit 1 under the condition of standing in front of the display unit 1.

For this reason, the conventional refrigerator is disadvantageous in that the user is spatially restricted in using the display unit 1 and feels fatigue when using it for a lengthy period of time, resulting in inconvenience of use.

SUMMARY OF THE INVENTION

Therefore, the present invention has been made in view of the above problems, and it is an object of the present invention to provide a system and method for switching a communication mode of a pad-detachable refrigerator, wherein a highly portable client pad is detachably attached to the outer surface of the refrigerator to extend a space for monitoring of the operating state of the refrigerator, and the attachment/detachment of the client pad to/from the refrigerator is sensed and the communication mode of the refrigerator is switched to a wired/wireless communication mode according to the sensed result so that signals can be efficiently transmitted and received in the switched communication mode.

In accordance with an aspect of the present invention, the above and other objects can be accomplished by the provision of a system for switching a communication mode of a detachable pad refrigerator, comprising: a client pad detachably attached to an outer surface of the refrigerator; a communication module installed in the refrigerator that transmits and receives signals to/from the client pad by wire or wirelessly; and refrigerator control unit that controls the communication module to automatically switch the communication mode of the refrigerator with the client pad to a wired/wireless communication mode according to the attachment/detachment of the client pad.

In accordance with another aspect of the present invention, a method is provided for switching a communication mode of a detachable pad refrigerator, comprising sensing attachment/detachment of a client pad to/from the refrigerator; enabling a wired communication module if the attachment of the client pad is sensed and a wireless communication module if the detachment of the client pad is sensed; transmitting and receiving signals to/from the client pad through the wired communication module or wireless communication module; and controlling an operation of the client pad and externally outputting results of the operation control.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

A Web pad (referred to hereinafter as a client pad) 100 is detachably attached to the outer surface of a pad-detachable refrigerator R according to the present invention. The Web pad is used as a display unit for the refrigerator R in its attached state and as a stand-alone device in its detached state.

The client pad 100 can wirelessly transmit and receive data to/from the refrigerator R through a wireless communication module, so it is not subject to a spatial restriction when being used in a building, resulting in convenience of use. That is, a user can input a control command or monitor displayed multimedia data through the client pad 100 under the condition of being distant from the refrigerator R.

For this wireless communication, the client pad is equipped with a wireless communication module such as a wireless local area network (LAN) module, so it can replace the display unit of the conventional refrigerator.

Figure 1:
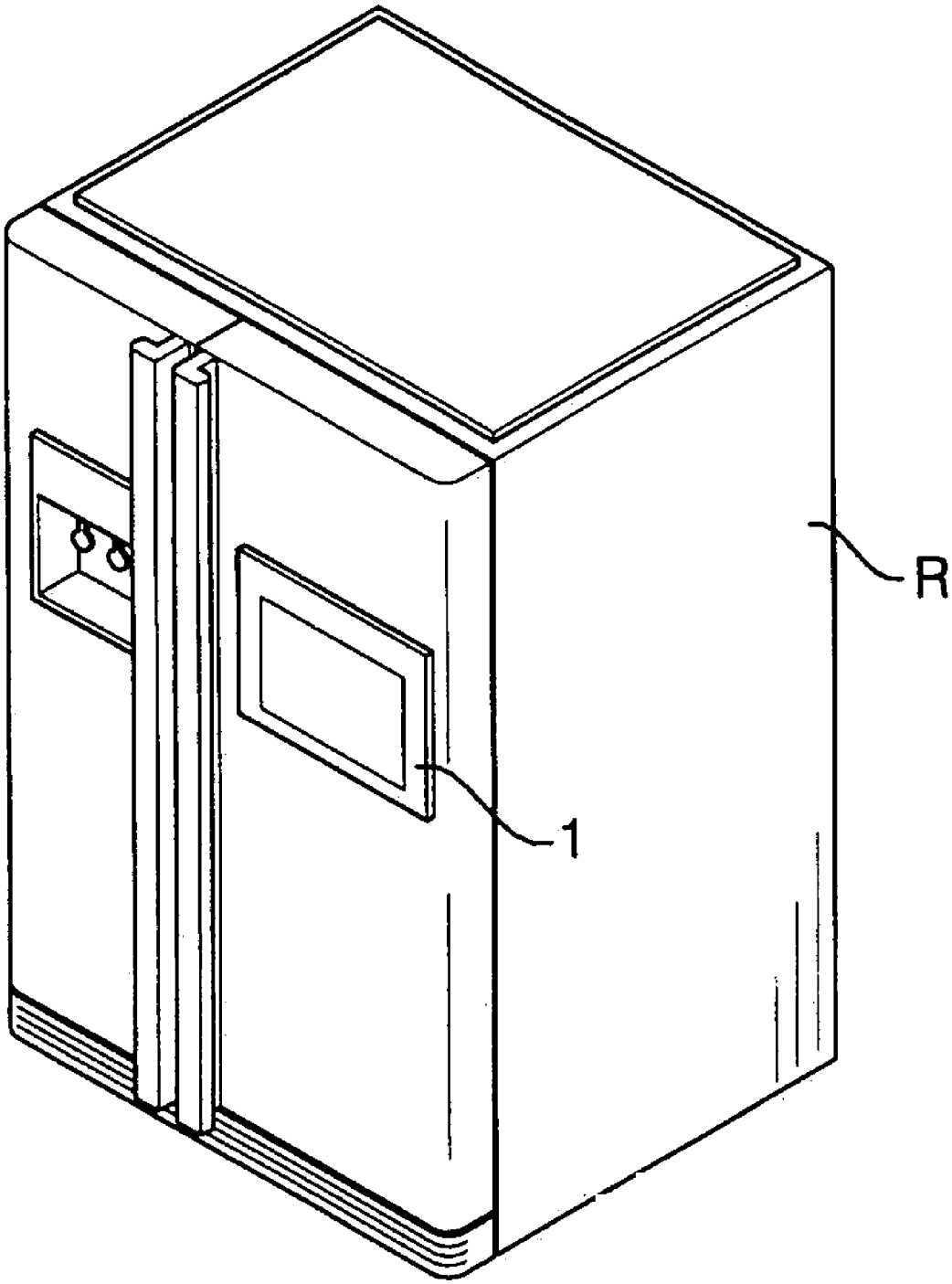
FIG. 1 (Prior Art)
FIG. 1 is a perspective view of a conventional refrigerator.
Figure 2:
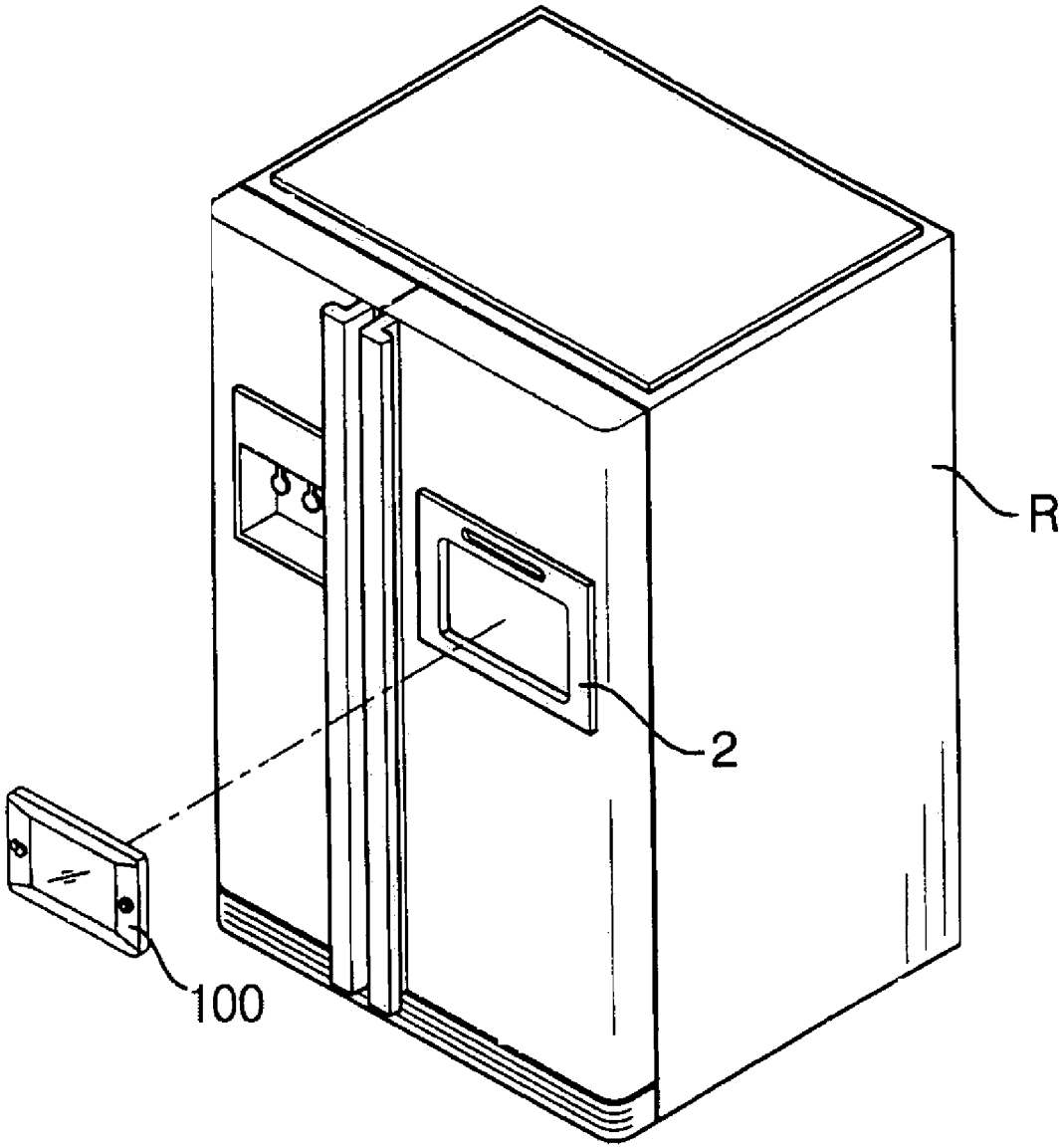
FIG. 2 is a perspective view of a pad-detachable refrigerator according to the present invention.
Figure 3:
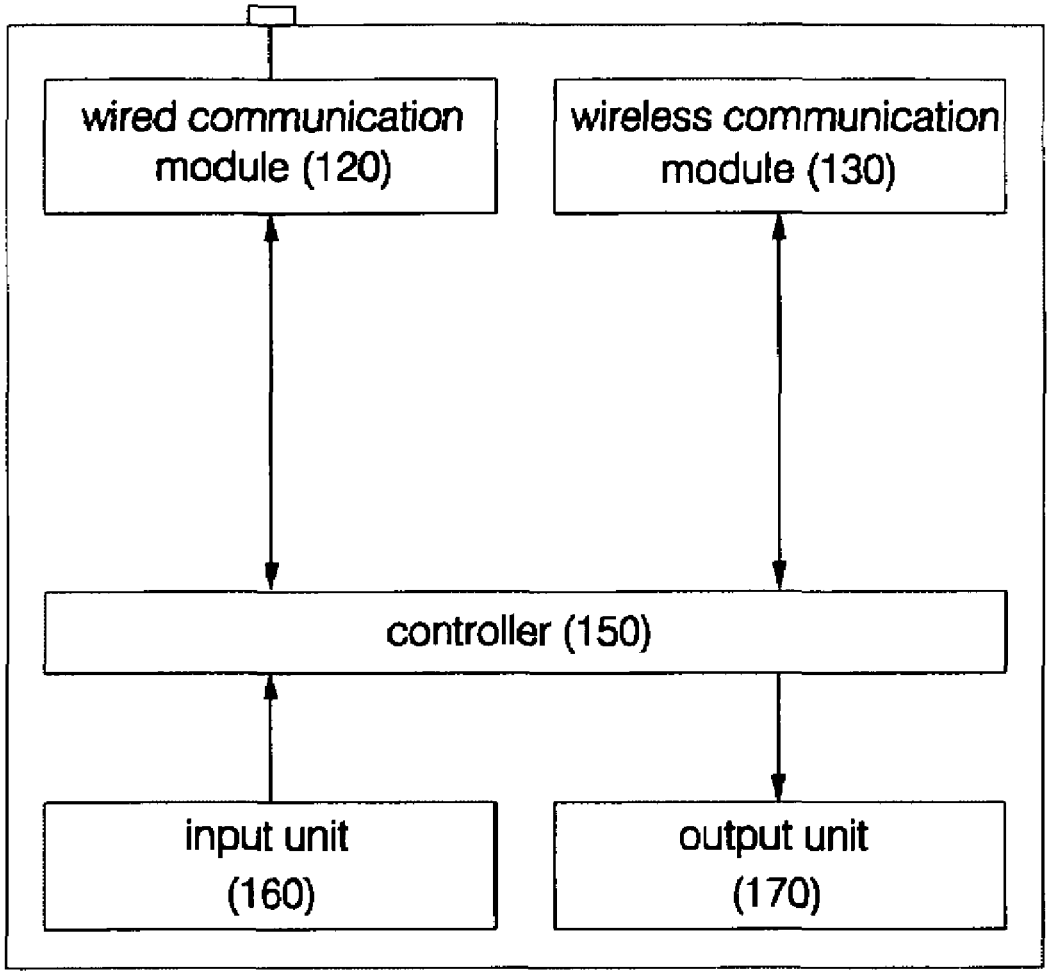
FIG. 3 is a block diagram showing the configuration of a client pad applied to the present invention.

Now, preferred embodiments of the present invention will be described in detail with reference to the annexed drawings. FIG. 2 is a perspective view of the pad-detachable refrigerator R according to the present invention, and FIG. 3 is a block diagram showing the configuration of the client pad 100 applied to the present invention.

As shown in FIG. 2, arranged at the front surface of the refrigerator R are a dispenser (not designated by any reference numeral) adapted to supply water or ice in accordance with the user's operation to bring a cup into contact with the dispenser, even in a closed state of a refrigerator door, and a home bar 2 for storing various beverage cans, etc. In order to detachably attach the client pad 100 to the front surface of the refrigerator R at a position corresponding to the home bar, the home bar 2 is provided with a recess having a depth corresponding to the thickness of the client pad 100.

The client pad 100 is preferably a personal digital assistant (PDA) for receiving the user's command inputted in a touch screen manner on its liquid crystal screen of a certain size and performing a variety of functions, such as E-mail transmission/reception, word processing, an electronic book, etc., which is typically called a tablet personal computer (PC). The client pad 100 is equipped with a wireless communication module so that it can be wirelessly networked with peripheral devices within a certain radius. Thus, the client pad 100 is able to transmit and receive signals to/from the refrigerator R.

This client pad 100 receives a refrigerator associated command, home networking command or Internet associated command inputted by the user, transmits the received commands to the refrigerator R, receives processed results based on those commands from the refrigerator R and displays the received results so that the user can readily monitor the processed results.

With reference to FIG. 3, the client pad 100 includes a wired communication module 120 for transmitting and receiving signals to/from the refrigerator R by wire, a wireless communication module 130 for wirelessly transmitting and receiving signals to/from the refrigerator R when the client pad 100 is detached from the refrigerator R, a controller 150 for controlling operations based on the signals transmitted and received to/from the refrigerator R through the wired communication module 120 or wireless communication module 130, and an output unit 170 for displaying operation results based on the control of the controller 150.

The client pad 100 further includes an input unit 160 having one or more buttons for inputting the user's control commands even under the condition that the client pad 100 is detached from the refrigerator R. Of course, the input unit 160 may be configured integrally with the output unit 170 to form a touch panel enabling a touch input.

Figure 4:
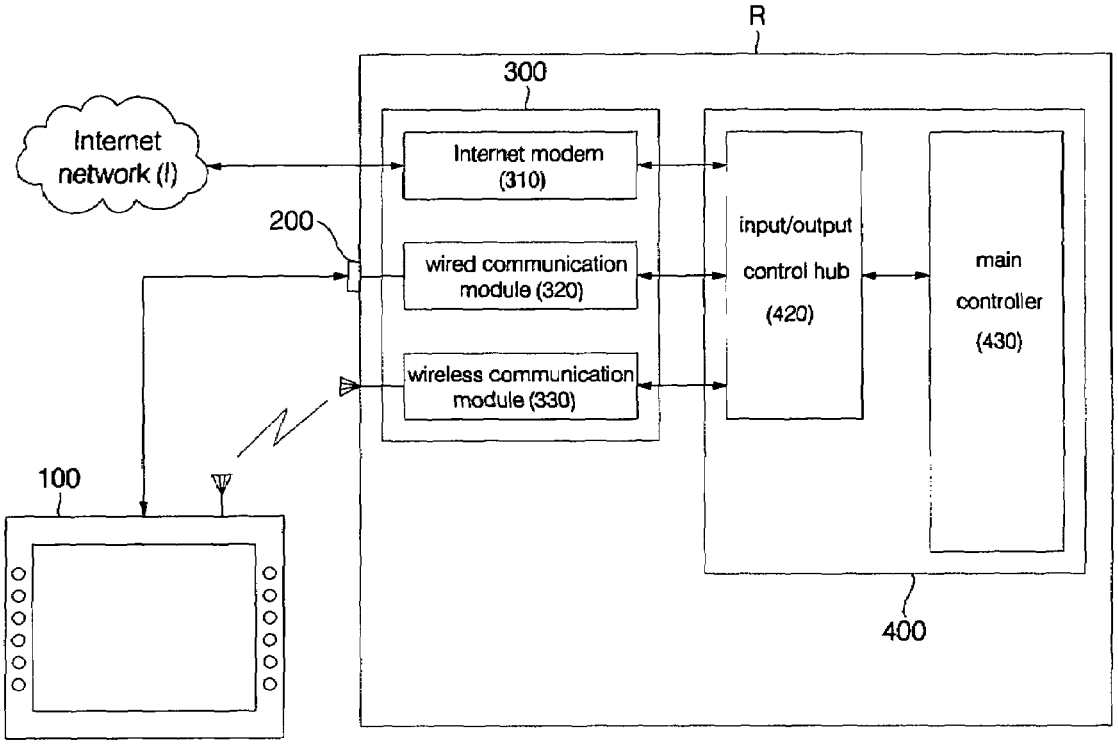
FIG. 4 is a block diagram showing a first embodiment of a system for switching a communication mode of the pad-detachable refrigerator according to the present invention.

FIG. 4 is a block diagram showing a first embodiment of a system for switching a communication mode of the pad-detachable refrigerator R according to the present invention.

A contact switch 200 is provided at a contact surface of a recess formed at the outer surface of the refrigerator R to sense whether the client pad 100 is brought into contact with the contact surface as it is attached to the recess.

The contact switch 200 is electrically connected with the system of the refrigerator R when the client pad 100 is attached to the refrigerator R. Although not limited in type, the contact switch 200 may be a protruded switch which is pressed at the same time as the attachment of the client pad 100, and may be electrically connected with the refrigerator system via a conductive metal plate.

A communication module set 300 is provided in the refrigerator R to transmit and receive signals to/from the client pad 100 by wire or wirelessly. The communication module set 300 basically includes an Internet modem 310 for processing signals transmitted and received over an external Internet network I.

The internal network of the building is connectable with an external network over the Internet network I via the Internet modem 310. As a result, a remote user of the external network can access the refrigerator R, which functions as a home server, to control the operation of a desired home appliance in the building.

The communication module set 300 further includes a wired communication module 320 for transmitting and receiving signals to/from the client pad 100 in a wired communication mode when the client pad 100 is attached to the refrigerator R, and a wireless communication module 330 for transmitting and receiving signals to/from the client pad 100 in a wireless communication mode when the client pad 100 is detached from the refrigerator R. These communication modules function to transmit and receive signals to/from one or more home appliances connected to the internal network and recognized as clients, as well as the client pad 100 detachably attached to the refrigerator R.

Therefore, in the case where the client pad 100 is attached to the refrigerator R, the refrigerator R excludes the unstable wireless communication mode and performs wired communication with the client pad 100 through the wired communication module 320, thereby making it possible to increase stability and reliability of the signal transmission and reception and save operating power.

On the other hand, in the case where the client pad 100 is detached from the refrigerator R, the communication mode of the refrigerator R is automatically switched to the wireless communication mode of the wireless communication module 330 so that signals can be transmitted and received in the wireless communication mode, thereby increasing mobility and portability of the client pad 100 by the user.

The wireless communication module 330 may preferably be any one of a series of wireless LAN standards 802.11b, 802.11a and 802.11g developed by IEEE, which can be set by a manufacturer. These standards are collectively referred to as 802.11 series. In brief, the 802.11b standard uses a 2.4 GHz frequency band, supports a data rate up to 11 Mbps and is most popular. The 802.11a standard offers improvements in security and network performance over the 802.11b standard, uses a 5 GHz frequency band and supports a data rate up to 54 Mbps. The 802.11g standard makes up for low compatibility of the 802.11a standard, supports a data rate up to 54 Mbps and is an evolved wireless LAN communication standard.

A refrigerator control unit 400 includes a main controller 430 for transmitting and receiving signals to/from one or more clients connected to the internal network of the building to perform the home server function, and an input/output control hub 420 for controlling the wired communication module 320 and wireless communication module 330 to switch the communication mode of the refrigerator R to the wired/wireless communication mode according to the attachment/detachment of the client pad 100.

The input/output control hub 420 controls the communication module set 300 to automatically switch the communication mode of the refrigerator R with the client pad 100 to the wired/wireless communication mode according to the attachment/detachment of the client pad 100.

Namely, in the first embodiment, where the client pad 100 is attached to the refrigerator R and thus connected with the wired communication module 320 via the contact switch 200, the input/output control hub 420 senses the attachment of the client pad 100, and thus transmits a signal generated by the main controller 430 to the client pad 100 by wire and receives a signal transmitted from the client pad 100 by wire.

On the other hand, where the client pad 100 is detached from the refrigerator R, the input/output control hub 420 senses the detachment of the client pad 100, and thus disables the wired communication module 320 and enables the wireless communication module 330, so as to transmit and receive signals between the main controller 430 and the client pad 100 in the wireless communication mode.

Figure 5:
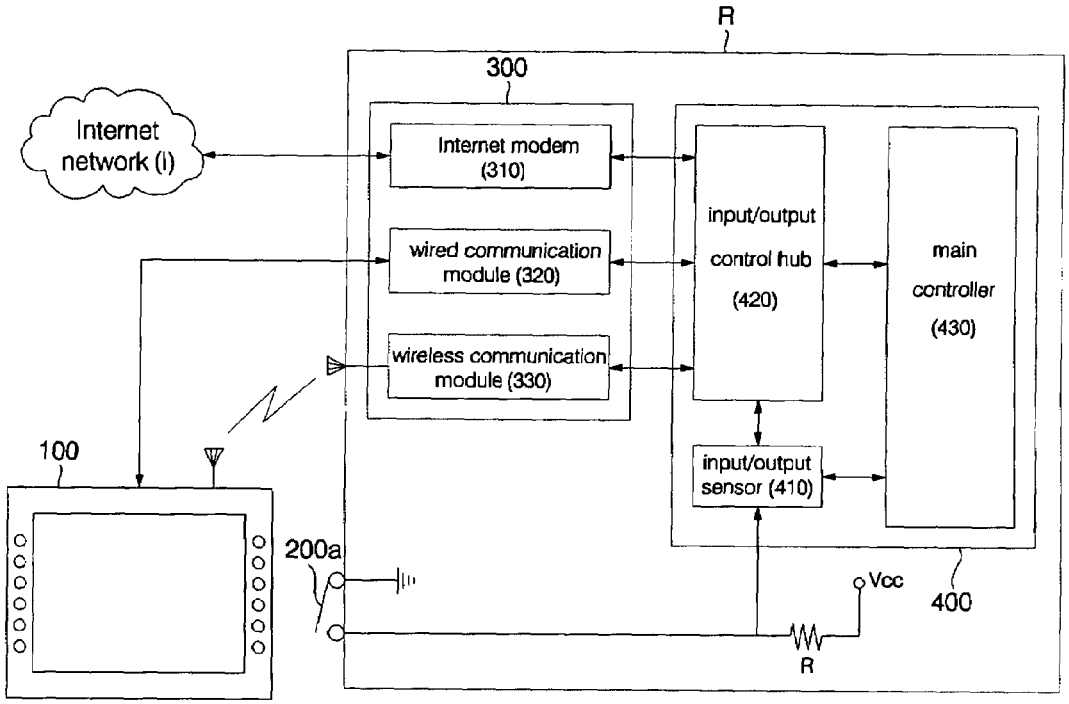
FIG. 5 is a block diagram showing a second embodiment of the system for switching the communication mode of the pad-detachable refrigerator according to the present invention.

In this manner, in the first embodiment, the input/output control hub 420 senses the attachment/detachment of the client pad 100 and controls the activation/deactivation of the wired and wireless communication modules 320 and 330 in accordance with the sensed result. FIG. 5 is a block diagram showing a second embodiment of the system for switching the communication mode of the pad-detachable refrigerator R according to the present invention. The second embodiment is different from the first embodiment in that an input/output sensor 410 is provided as separate attachment/detachment sensing means to sense the attachment/detachment of the client pad 100 and transfer the sensed result to the input/output control hub 420.

A contact switch 200*a* is provided at a portion of the outer surface of the refrigerator R with which the client pad 100 is brought into contact, and is turned on/off according to the attachment/detachment of the client pad 100. If the contact switch 200*a* is turned on, a desired voltage (Vcc/R) is applied to the input/output sensor 410.

The input/output sensor 410 transfers the applied voltage to the input/output control hub 420 to inform it of the attachment of the client pad 100. As a result, the input/output control hub 420 enables the wired communication module 320 to transmit and receive signals to/from the client pad 100 in the wired communication mode.

On the other hand, if no voltage is applied to the input/output sensor 410, the input/output control hub 420 determines the client pad 100 to be detached, and thus enables the wireless communication module 330 to transmit and receive signals to/from the client pad 100 in the wireless communication mode.

Figure 6:
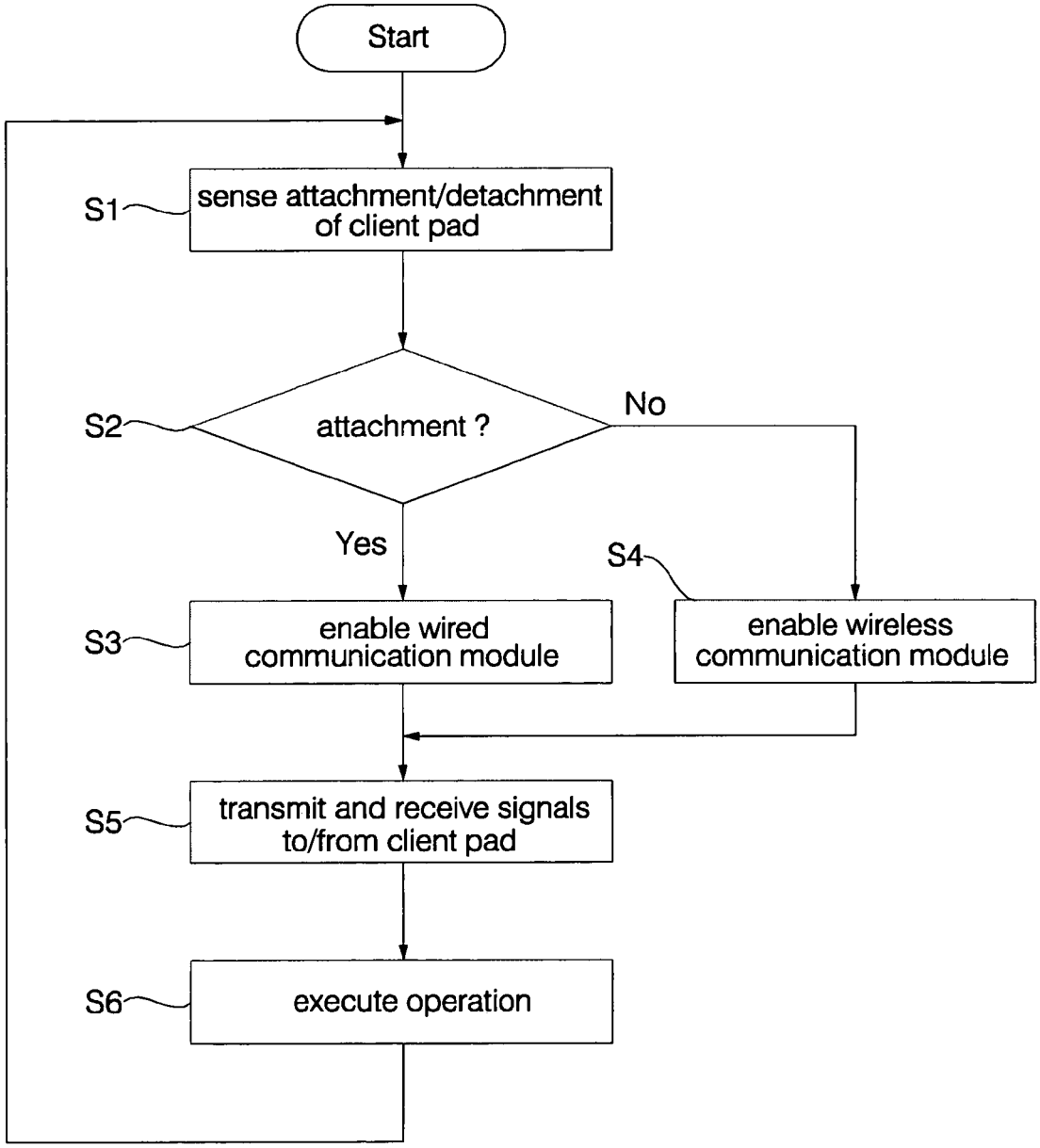
FIG. 6 is a flow chart illustrating a method for switching the communication mode of the pad-detachable refrigerator according to the present invention.

Next, a method for switching the communication mode of the pad-detachable refrigerator R according to the present invention will be described with reference to FIG. 6.

First, the input/output control hub provided in the refrigerator senses the attachment/detachment of the client pad through the contact switch formed on the outer surface of the refrigerator (S1).

If the attachment of the client pad is sensed (S2), the input/output control hub enables the wired communication module. At this time, the wireless communication module remains disabled, so efficient system management can be established (S3).

However, in the case where the detachment of the client pad is sensed, the input/output control hub enables the wireless communication module. At this time, the wired communication module is kept disabled as long as it transmits and receives no signals to/from any home appliance connected to the internal network (S4).

Hence, the refrigerator system transmits and receives signals to/from the client pad through the communication module. For example, data downloaded from a desired Web page connected through the Internet modem of the refrigerator may be transferred to the client pad so as to be displayed thereon, or a control command signal inputted from the input unit of the client pad may be transferred to the refrigerator system (S5).

Both the client pad and the refrigerator control unit execute operations based on received signals (S6).

As apparent from the above description, the present invention provides a system and method for switching a communication mode of a pad-detachable refrigerator, wherein a contact switch is provided to sense attachment/detachment of a client pad to/from the refrigerator and the communication mode of the refrigerator is switched to a wired/wireless communication mode according to the sensed result, thereby making it possible to increase stability and reliability of signal transmission and reception and efficiently use operating power. Further, a user can conveniently monitor refrigeration status information, home network status information, Internet data and so forth without any spatial restriction.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A system for switching a communication mode of a detachable pad refrigerator, comprising:

a client pad configured to detachably attach to a surface of said refrigerator;

a communication module installed in said refrigerator that transmits and receives signals to and from said client pad by wire or wirelessly;

a contact switch, provided at a location on the outer surface of said refrigerator, which said client pad contacts, said contact switch sensing whether said client pad is attached to said refrigerator; and a refrigerator controller that controls said communication module to automatically switch said communication mode of said refrigerator with said client pad between a wired communication mode and a wireless communication mode according to whether said client pad is attached to said refrigerator.

2. The system as set forth in claim 1, further comprising:

an input/output sensor electrically connected with said contact switch, said sensor sensing an on/off state of said contact switch and transferring a sensed result to said refrigerator controller.

3. The system as set forth in claim 2, wherein said contact switch is connected to a power supply voltage source to apply a voltage to said refrigerator controller when it is turned on.

4. The system as set forth in claim 1, wherein said contact switch is turned on and off according to whether said client pad is attached to said refrigerator and is electrically connected with said refrigerator controller when it is turned on.

5. The system as set forth in claim 1, wherein said communication module includes:

a wired communication module that transmits and receives signals to and from said client pad in said wired communication mode when said client pad is attached to said refrigerator; and a wireless communication module that transmits and receives signals to and from said client pad in said wireless communication mode when said client pad is detached from said refrigerator.

6. The system as set forth in claim 5, wherein said communication module further includes an Internet modem that transmits and receives signals to/from an external system over the Internet.

7. The system as set forth in claim 1, wherein said refrigerator control unit includes:

a main controller that transmits and receives signals to/from one or more clients connected to a home network provided in a building to perform a home server function; and an input/output control hub that controls said communication module to switch said communication mode of said refrigerator to said wired/wireless communication mode according to the attachment/detachment of said client pad.

8. The system as set forth in claim 1, wherein said client pad includes:

a wired communication module that transmit and receives signals to and from said refrigerator controller by wire when said client pad is attached to said refrigerator;

a wireless communication module that wirelessly transmits and receives signals to and from said refrigerator controller when said client pad is detached from said refrigerator;

a controller that controls operations based on the signals transmitted and received to and from said refrigerator controller through said wired communication module or wireless communication module; and an output unit that displays operation results based on the control of said controller.

9. The system as set forth in claim 8, wherein said client pad further includes an input unit, said input unit having at least one button for directly inputting a user's control commands.

10. The system as set forth in claim 8, wherein said client pad further includes an input unit configured integrally with said output unit for forming a touch panel enabling a touch input.

11. A method for switching a communication mode of a detachable pad refrigerator, comprising:

sensing whether a client pad is attached to said refrigerator according to an on/off state of a contact switch;

enabling a wired communication module when it is sensed that the client pad is attached to said refrigerator, and enabling a wireless communication module when it is sensed that the client pad is not attached to said refrigerator;

transmitting and receiving signals to and from said client pad through said wired communication module or wireless communication module; and controlling an operation of said client pad and externally outputting results of the operation control.

12. A system for switching a communication mode of a refrigerator, comprising:

a client pad configured to detachably attach to said refrigerator;

a communication module, installed in said refrigerator, that communicates with said client pad via a wired connection in a wired communication mode and via a wireless connection in a wireless communication mode;

an attachment sensor, provided on the refrigerator, which senses whether said client pad is attached to said refrigerator; and a refrigerator controller that switches said a communication mode of the communication module between said wired communication mode and said wireless communication mode based on an output of the attachment sensor.

13. The system according to claim 12, wherein the refrigerator controller switches the communication mode of the communication module to the wired communication mode when the attachment sensor senses that the client pad is attached to the refrigerator, and switches the communication mode of the communication module to the wireless communication mode when the attachment sensor senses that the client pad is not attached to the refrigerator.

14. The system according to claim 12, wherein the refrigerator controller is configured to establish a connection between the client pad and a network, and maintain the connection between the client pad and the network when said refrigerator controller switches the communication mode of the communication module between said wired communication mode and said wireless communication mode.

15. The system according to claim 1, wherein the refrigerator controller is configured to establish a connection between the client pad and a network, and maintain the connection between the client pad and the network when said refrigerator controller switches the communication mode of the communication module between said wired communication mode and said wireless communication mode.

* * * * *

UNITED STATES PATENT AND TRADEMARK OFFICE

CERTIFICATE OF CORRECTION

PATENT NO. : 7,178,349 B2
APPLICATION NO. : 10/769926
DATED : February 20, 2007
INVENTOR(S) : Y. H. Roh et al.

It is certified that error appears in the above-identified patent and that said Letters Patent is hereby corrected as shown below:

Column 7, line 32 (claim 8, line 3) of the printed patent, “transmit” should be --transmits--.

Signed and Sealed this

Third Day of June, 2008

JON W. DUDAS
*Director of the United States Patent and Trademark Office*